US011293455B2

(12) United States Patent
Nowitzki et al.

(10) Patent No.: US 11,293,455 B2
(45) Date of Patent: Apr. 5, 2022

(54) DIFFUSER ASSEMBLY FOR UPWARD, DOWNWARD AND RADIAL PUMP PROTECTION

(71) Applicant: Halliburton Energy Services, Inc., Houston, TX (US)

(72) Inventors: Wesley John Nowitzki, Tulsa, OK (US); Joshua W. Webster, Sand Springs, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/346,967

(22) PCT Filed: May 31, 2018

(86) PCT No.: PCT/US2018/035437
§ 371 (c)(1),
(2) Date: May 2, 2019

(87) PCT Pub. No.: WO2019/231454
PCT Pub. Date: Dec. 5, 2019

(65) Prior Publication Data

US 2021/0071683 A1 Mar. 11, 2021

(51) Int. Cl.
*F04D 29/54* (2006.01)
*F04D 13/10* (2006.01)
(Continued)

(52) U.S. Cl.
CPC ..... *F04D 29/548* (2013.01); *E21B 43/128* (2013.01); *F04D 1/08* (2013.01);
(Continued)

(58) Field of Classification Search
CPC ... F04D 1/08; F04D 1/06; F04D 1/063; F04D 1/066; F04D 29/44; F04D 29/445;
(Continued)

(56) References Cited

U.S. PATENT DOCUMENTS 4,781,531 A * 11/1988 James ..... F04D 29/026 415/196
2014/0050570 A1* 2/2014 Jayaram ..... F04D 13/08 415/169.1
(Continued)

FOREIGN PATENT DOCUMENTS

WO WO 2015/009428 A1 1/2015

OTHER PUBLICATIONS

International Search Report and the Written Opinion of the International Search Authority, or the Declaration, dated Feb. 25, 2019, PCT/US2018/035437, 15 pages, ISA/KR.

*Primary Examiner* — Bryan M Lettman
(74) *Attorney, Agent, or Firm* — Haynes and Boone, LLP

(57) ABSTRACT

A diffuser subassembly for use in downhole submersible pump assemblies includes a bearing set for supporting a drive shaft of the pump assemblies. The bearing set includes a sleeve for supporting the drive shaft in upward, downward and radial directions. The sleeve includes a central flange captured axially between a pair of bushings fixed to a diffuser body. Axial loads from the drive shaft may be transferred through the central flange of the sleeve to one or the other of the bushings into the diffuser body to accommodate upward and downward thrust forces. The bushings may be keyed to discourage rotational motion with respect to the diffuser body.

20 Claims, 4 Drawing Sheets

(51) Int. Cl.
*F04D 29/64* (2006.01)
*E21B 43/12* (2006.01)
*F04D 1/08* (2006.01)

(52) U.S. Cl.
CPC ..... *F04D 13/10* (2013.01); *F04D 29/648* (2013.01); *Y10T 29/49236* (2015.01)

(58) Field of Classification Search
CPC ..... F04D 29/54; F04D 13/10; F04D 29/0413; F04D 29/046; F04D 29/62; F04D 29/40–29/548; F04D 29/60–29/648; Y10T 29/49236; Y10T 29/4984; F04C 2230/60; E21B 43/128; F16C 17/04; F16C 17/107; F16C 2352/00
See application file for complete search history.

(56) References Cited

U.S. PATENT DOCUMENTS

| | | | | |
|---|---|---|---|---|
| 2015/0159666 | A1 | 6/2015 | McManus et al. | |
| 2015/0226219 | A1* | 8/2015 | Johnson ..... | F04D 13/10 417/423.3 |
| 2016/0115998 | A1 | 4/2016 | Jayaram et al. | |
| 2018/0291917 | A1* | 10/2018 | Webster ..... | F16C 17/02 |

* cited by examiner

DIFFUSER ASSEMBLY FOR UPWARD, DOWNWARD AND RADIAL PUMP PROTECTION

PRIORITY

The present application is a U.S. National Stage patent application of International Patent Application No. PCT/US2018/035437, filed on May 31, 2018, the benefit of which is claimed and the disclosure of which is incorporated herein by reference in its entirety.

BACKGROUND

The present disclosure relates generally electrical submersible pumping equipment useful in operations related to subterranean wellbores, e.g., for oil and gas exploration, drilling and production. More particularly, embodiments of the disclosure include bearing assemblies for electric submersible pumps that include a support mechanism for reducing operational wear and fretting.

A variety of pumping systems have been employed to lift fluids from subterranean wellbore locations to the surface. One such pumping system is an Electrical Submersible Pump (ESP), which may be supported within the wellbore and submersed in the fluids to be produced. Generally, an ESP includes a pump and a drive motor, which operate together to pressurize the wellbore fluids and pass them through production tubing to the surface. For example, the pump may include an impeller coupled with a stationary diffuser, and the drive motor may rotate the impeller to impart an upward thrust to the wellbore fluid. Often, impeller and diffuser pairs are stacked in stages along a shaft coupled to the drive motor. An ESP may be operational over a span of months or years in a wellbore, causing extended exposure environmental and operational wear. Accordingly, ESP components must be robust and constructed in a manner to manage the expected wear.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure includes a diffuser subassembly for use, e.g., in wellbore pumps such as downhole submersible pump assemblies or surface installed pump assemblies fluidly coupled to a wellbore. The wellbore pumps may be operable, e.g., to facilitate production of hydrocarbon or other fluids from a geologic formation through the wellbore, and/or to inject water, $CO_2$ or other fluids into the wellbore. The diffuser assembly includes a sleeve therein for supporting a drive shaft in upward, downward and radial directions. The sleeve includes a central flange captured axially between a pair of bushings press-fit into a diffuser body. Axial loads from the drive shaft may be transferred through the central flange of the sleeve to one or the other of the bushings into the diffuser body. The bushings may be keyed to discourage rotational motion with respect to the diffuser body.

Figure 1:
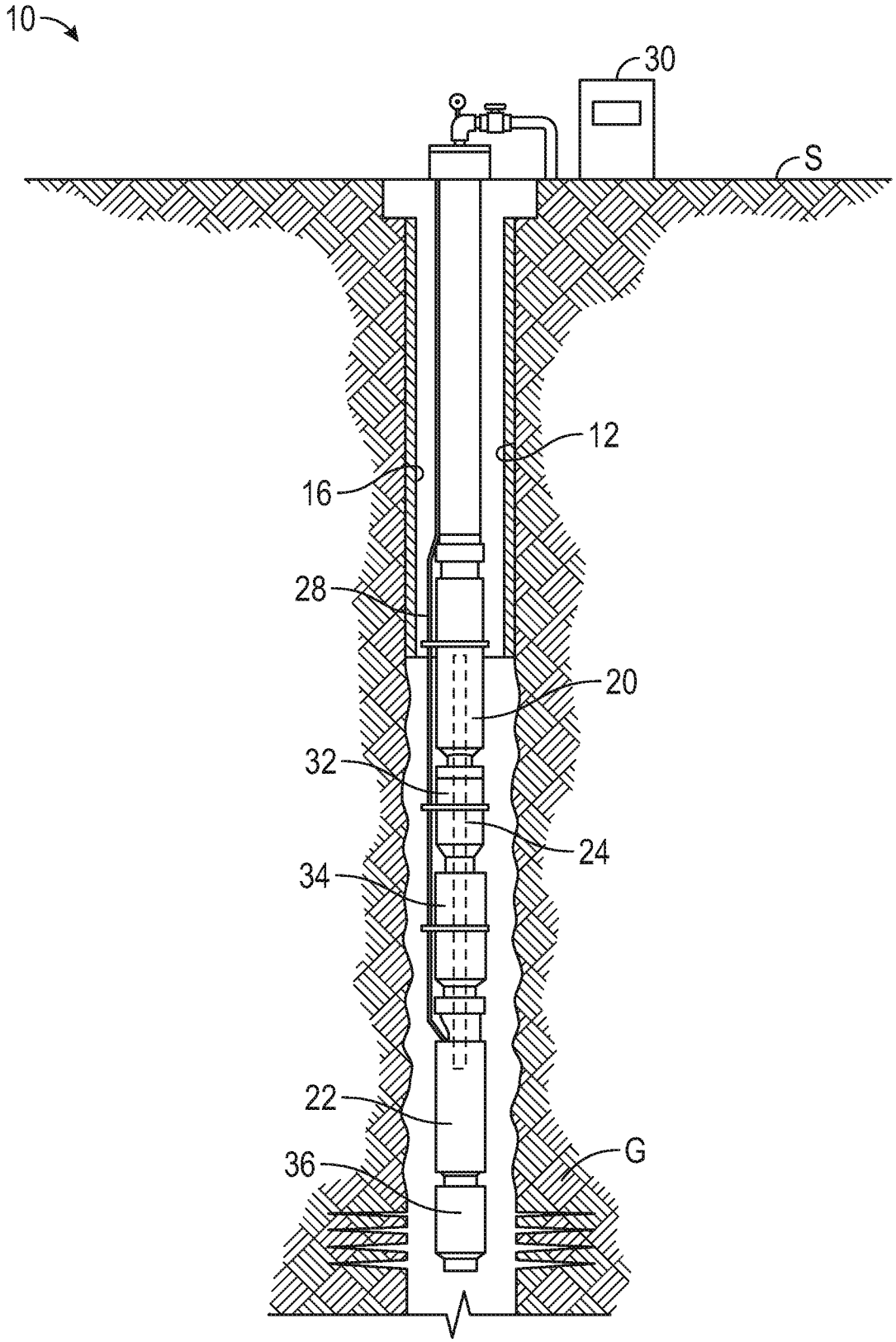
FIG. 1 is a partial cross-sectional side view a wellbore ESP system including a pump and drive motor in accordance with embodiments of the present disclosure.

An example embodiment of a wellbore ESP system 10 in accordance with some embodiments of the present disclosure is illustrated in FIG. 1. The wellbore ESP system 10 is deployed in a wellbore 12 extending from a surface location "S" into a geologic formation "G." In the illustrated embodiment, the wellbore 12 extends from a terrestrial or land-based surface location "S." In other embodiments (not shown), the wellbore ESP system 10 may be employed satisfactorily in wellbores extending from offshore or subsea surface locations using with appropriate equipment such as offshore platforms, drill ships, semi-submersibles and drilling barges. The wellbore 12 defines an "uphole" direction referring to a portion of wellbore 12 that is closer to the surface location "S" and a "downhole" direction referring to a portion of wellbore 12 that is further from the surface location "S."

Wellbore 12 is illustrated in a generally vertical orientation. In other embodiments, the wellbore 12 may include portions in alternate deviated orientations such as horizontal, slanted or curved without departing from the scope of the present disclosure. Wellbore 12 optionally includes a casing string 16 therein, which extends generally from the surface location "S" to a selected downhole depth. Portions of the wellbore 12 that do not include casing string 16 may be described as "open hole."

Various types of downhole hydrocarbon fluids may be pumped to the surface location "S" with ESP 20 deployed in the wellbore 12. The ESP 20 may be a multi-stage centrifugal pump that functions to transfer pressure to the hydrocarbon fluids (and/or other wellbore fluids present) to propel the fluids from to the surface location "S" at a desired pumping rate. ESP 20 may have any suitable size or construction based on the characteristics, e.g., wellbore size, desired pumping rate, etc., of the subterranean operation for which the ESP 20 is employed. The ESP 20 may operate, e.g., by adding kinetic energy to the hydrocarbon fluids via centrifugal force, and convert the kinetic energy to potential energy in the form of pressure using one or more impellers and diffusers as discussed below in greater detail with reference to FIG. 2.

The wellbore ESP system 10 includes a motor 22 for driving the one or more impellers in the ESP 20. A drive shaft 24 may operably connect the motor 22 to transmit the rotation of motor 22 to one or more impellers located in ESP 20 and thereby cause the impellers to rotate. The motor 22 may also be coupled by a cable 28 to a controller 30 at the surface location "S," which may provide instructions to the motor 22 for operating in a particular manner. In other embodiments, a controller may be disposed at a downhole location.

Other various components of wellbore ESP system 10 include an intake 32, seal chamber 34, and sensor package 36. The intake 32 may allow fluid to enter the bottom of ESP 20 and flow to the first stage of the ESP 20. Seal chamber 34 may extend the life of the motor 22 by, e.g., protecting the motor 22 from contamination, and providing pressure equalization between the motor 22 and the wellbore 12.

The motor 22 may operate at high rotational speeds, such as 3,500 revolutions per minute, to thereby drive the rotation of the impellers in the ESP 20. Rotation of the impellers may cause the ESP 20 to pump fluid to the surface location "S." The sensor package 36 may include one or more sensors used to monitor the operating parameters of the ESP 20 and/or conditions in the wellbore 12, such as the intake pressure, casing annulus pressure, internal motor temperature, pump discharge pressure and temperature, downhole flow rate, or equipment vibration. The sensor package 36 may be communicatively coupled to the controller 30.

As hydrocarbon fluid travels through the ESP 20, the pressure of fluid may generally increase at each stage due to the fluid traveling through the diffuser. The increase in pressure through each stage of the ESP 20 may result in a down-thrust condition. A down-thrust condition may exist when the pressure is higher in a subsequent stage of the ESP 20 in the direction of the fluid flow (referred to as a "higher stage") than the pressure in a previous stage of the ESP 20 (referred to as a "lower stage"). In some embodiments, a higher stage may be located uphole from a lower stage.

In some circumstances, an up-thrust condition may occur. An up-thrust condition may exist when the inertial forces of the fluid in ESP 20 toward a higher stage of ESP 20 overcome the downthrust force component. As discussed hereinbelow, upthrust and downthrust forces may be accommodated by diffuser assemblies of the present disclosure.

Figure 2:
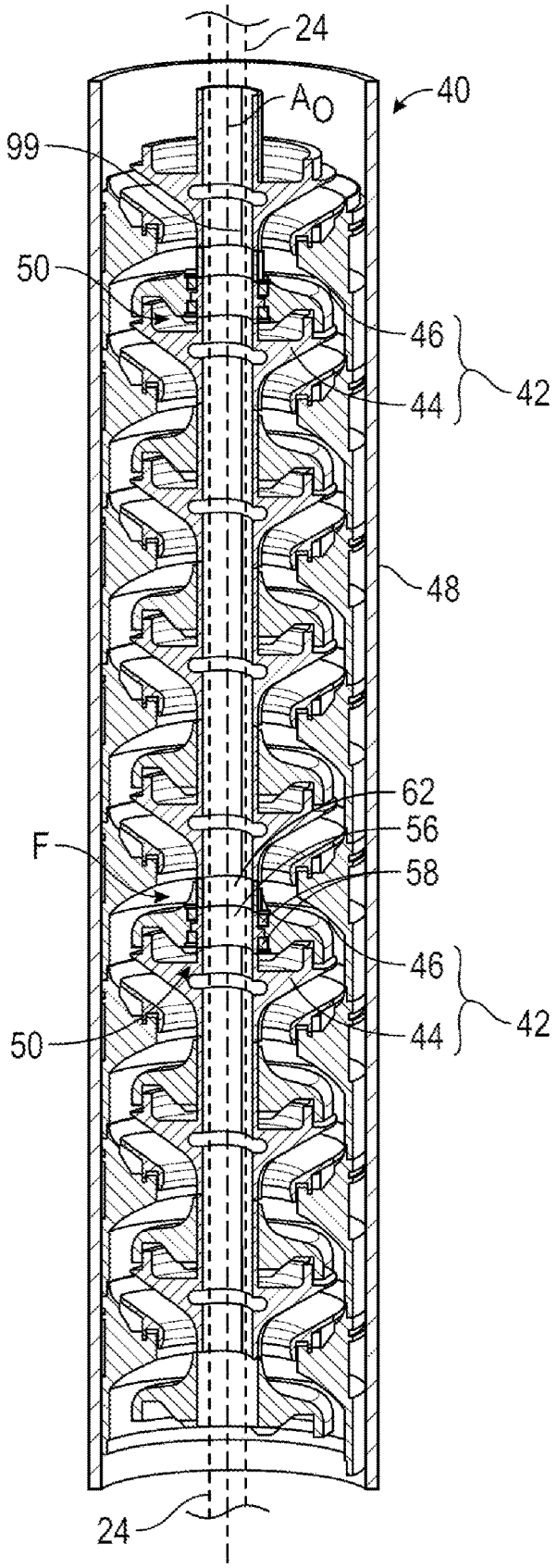
FIG. 2 is a perspective cross-sectional view of an impeller and diffuser stack for a the pump of FIG. 1 illustrating a pair of diffuser subassemblies each having a bearing set employing a single sleeve with a flange for supporting a drive shaft.

An impeller and diffuser stack 40 within the ESP 20 defines a longitudinal axis $A_0$ as illustrated in FIG. 2. Example embodiments of the stack 40 include one or more stages 42 stacked along the drive shaft 24. Each stage 42 includes an impeller 44 operatively coupled to the drive shaft 24 such that rotation of the drive shaft about the axis $A_0$ induces rotation of the impeller 44 about the axis $A_0$. Each stage 42 also includes a diffuser body 46, having a flowpath "F" therethrough that reduces the velocity of a fluid while increasing its static pressure as recognized in the art. The diffuser body 46 may be arranged not to rotate along with the drive shaft 24. For example, the diffuser body 46 may be held stationary with respect to a housing 48 of the ESP 20. A bearing set 50 may be included within one or more stages 42 to provide thrust and radial support for the rotation of the drive shaft 24. The stack 40 illustrated in FIG. 2 includes two stages 42 including bearing sets 50, while other stages 52 that do not include bearing sets. In other embodiments, more or fewer stages 42 with bearing sets 50 may be provided.

Bearing set 50 and may include a sleeve 56 and a pair of bushings 58 coupled to the diffuser body 46. The bearing set 50 may be constructed of abrasion-resistant components and may include materials such as tungsten carbide, silicon carbide or titanium carbide. Sleeve 56 and impeller 44 may be secured to the drive shaft 24, such as by a key, and may rotate with the drive shaft 24. The diffuser body 46 and the bushings 58 should not rotate about the axis $A_0$. Bushings 58 may be pressed into the diffuser body 46 by interference fit or may be secured to the diffuser body 46 in an alternate manner recognized in the art. Sleeve 56 may include a central flange 84 (see FIG. 3A) to provide thrust support to the drive shaft 24 and/or carry axial loads in both upward and downward directions. A standoff sleeve 62 may support impeller 44, and a length of standoff sleeve 62 may determine the operating height of impeller 44. Standoff sleeve 62 may be constructed of a Ni-resist austenitic cast iron alloy or stainless steel if shimmed.

Figure 3A:
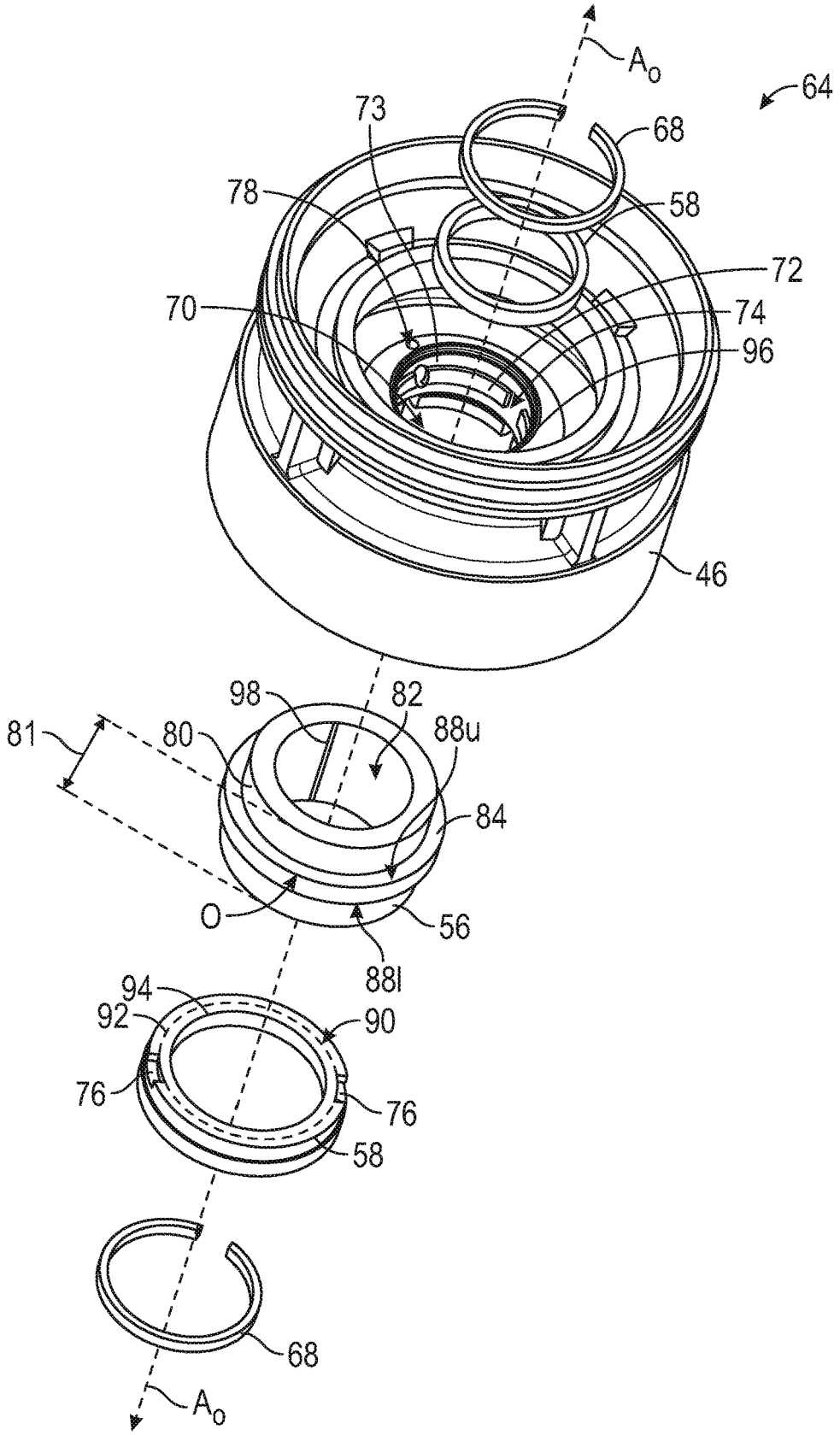
FIG. 3A is a perspective view of one of the diffuser subassemblies of FIG. 2 illustrated with parts separated.

FIG. 3A illustrates a diffuser subassembly 64 with parts separated, which may facilitate construction of one of the stages 42 (FIG. 2). The diffuser subassembly 64 generally includes the diffuser body 46, sleeve 56, bushings 58 and lock rings 68. The diffuser body includes a central bore 70 for receiving the sleeve 56, bearings 58 and lock rings 68 therein. The central bore 70 includes a rim 72 projecting inwardly from an inner surface 73 of the diffuser body 46. The rim 72 does not extend over a full circumference of the inner bore 70, but includes interruptions therein to define gaps 74. The gaps 74 are sized to circumferentially accommodate tabs 76 of the bushings 58. In operation, the tabs 76 extend into the gaps 74 such that the tabs 76 circumferentially engage the rim 72 and prohibit free rotation of the bushings 58 about the longitudinal axis $A_0$. An optional fluid flow passage 78 intersects the rim 72, and permits the passage of fluids into and out of the central bore 70 to lubricate and/or cool the sleeve 56.

The sleeve 56 includes a generally cylindrical body portion 80 extending an axial length 81 of the sleeve 56. A bore 82 extends axially through the body portion 80 for receiving the drive shaft 26 (FIG. 2) therein. The bore 82 may include a key slot 99 or other geometry for rotationally fixing the sleeve 56 to the drive shaft 26. In other embodiments, the bore 82 may be generally smooth. A flange 84 extends radially from a central region of the body portion 80. In some embodiments, the central flange 84 may intersect an axial center "O" of the body portion 80 of the sleeve 56. The axial center "O" is disposed half the axial length 81 from either longitudinal end of the body portion 80. The central flange 84 defines upper and lower thrust surfaces **88*u* and 88*l*, respectively on opposite sides of the axial center "O." The upper and lower thrust surfaces 88*u* and 88*l* are axially separated from longitudinal ends of the body portion 80**. As used herein, the terms "upper" and "lower" are relative terms describing portions of an apparatus that may be positioned above or below one another, depending on the orientation of the apparatus.

The bushings 58 define axially facing thrust surfaces 90 thereon. An outer perimeter 92 of the thrust surfaces 90 may engage the rim 72 of the diffuser body 46 when pressed or otherwise assembled into the central bore 70 of the diffuser body 46. The tabs 76 of the bushings extend axially from the thrust surfaces 90 and extend into the circumferential gaps 74 defined in the rim when the bushings 58 are assembled to the diffuser body 46. An inner perimeter 94 of the trust faces 90 may engage the thrust surfaces **88*u*, 88*l* of the sleeve 56 in operation to absorb up-thrust and down-thrust forces from the drive shaft 24. The bushings 58 are illustrated as identical components facing opposite axial directions. In other embodiments (see FIG. 4**) the bushings may exhibit dissimilar geometries.

The lock rings 68 are arranged to be received in corresponding annular grooves 96 defined in the central bore 70 of the diffuser body 46. The lock rings 68 may have a c-shaped or other cross section to provide some flexibility to the lock rings 68 and permit the lock rings to be radially compressed for installation into the grooves 96. After installation, the lock rings 68 may return to their un-compressed configuration to axially retain the bushings 58 therebetween. The lock rings may be constructed of various materials such as stainless steel, carbon steel, inconel, Ni-resist, etc.

Figure 3B:
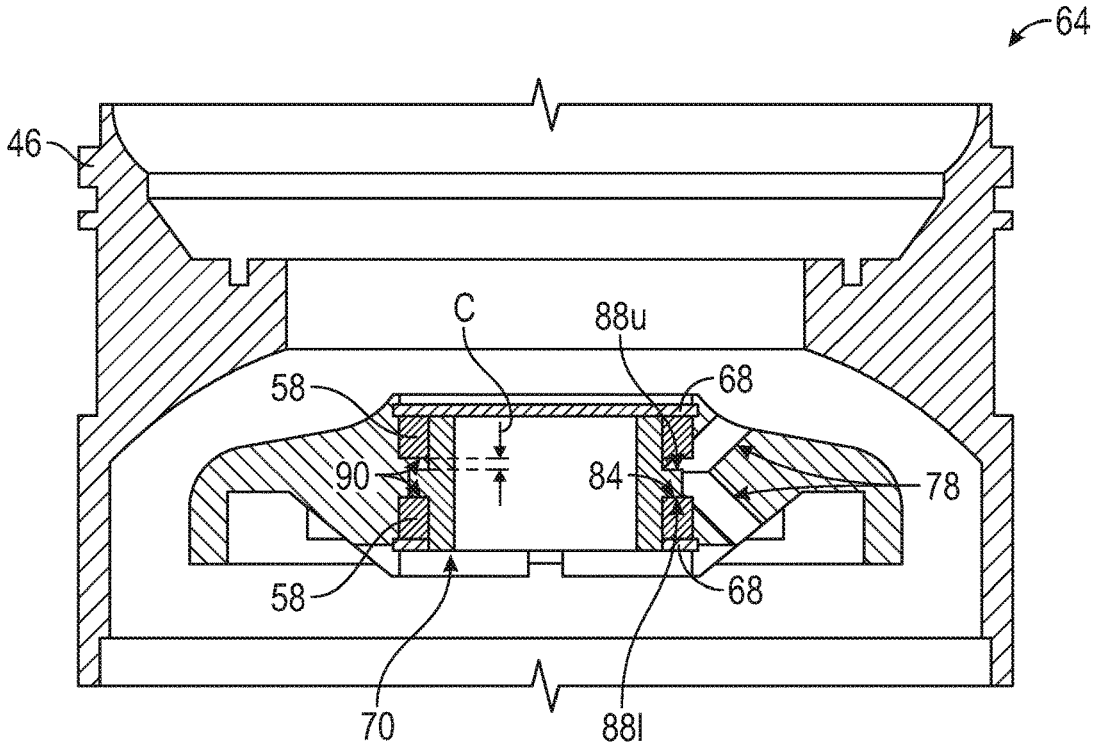
FIG. 3B is a cross-sectional side view of the diffuser assembly of FIG. 3A illustrated with parts assembled.

FIG. 3B illustrates the diffuser subassembly 64 with parts assembled. The bushings 58 are pressed into the bore 70 of the diffuser body 46 forming an interference fit therewith. In some embodiments, the interference fit may be sufficiently robust for retaining the bushings 58 to the diffuser body, and the lock rings 68 are installed to provide a back-up retaining mechanism. The sleeve 56 is positioned with the flange 84 captured axially between the thrust surfaces 90 of the bushings 58 and radially within the rim 72 of the diffuser body 46. The rim 72 has a greater axial length than an axial length of flange 84, and thus, an axial clearance "C" is defined between the flange 84 and the bushing 58. The fluid flow passage 78 extends at an oblique angle into the central bore 70 and intersects the clearance "C" to permit the fluids passing through the fluid flow passage 78 to lubricate the flange 84.

In operation, the sleeve 56 with a central flange 84 provides upward and downward thrust protection utilizing just one sleeve. When an up-thrust condition is encountered, the upper thrust surface 88*u* of the flange 84 may engage the thrust surface 90 of an upper bushing 58. Similarly, when a down-thrust condition is encountered, the lower thrust surface 88*l* of the flange 84 engages the thrust surface 90 of a lower bushing 58. The thrust surfaces 88*u*, 88*l* and 90 are generally flat and normal to the longitudinal axis $A_0$. Thus, thrust loads may be transferred therebetween while the thrust surfaces 88*u*, 88*l* and 90 rotate with respect to one another. With the flange 84 disposed generally in the axial center of the sleeve 56, the deflection of the sleeve 56 due to moments about the radial support, e.g., the inner diameter of the rim 72 (see FIG. 3A), may be reduced with respect to other configurations. For example, a greater deflection would be encountered when a sleeve having a flange on an axial end thereof (see FIG. 4) absorbs a thrust load at one end, since the opposite end of the sleeve would be a greater distance from the thrust load. Thus, by placing the thrust absorption faces, e.g., 88*u* and 88*l* at the axial center of the sleeve 56 the deflection of the sleeve 56 may be reduced, thereby reducing the wear and fretting of the shaft 24 (FIG. 2).

A single sleeve 56 arranged to absorb both up-thrust forces and down-thrust force may also lower the cost of a diffuser subassembly 64, as compared to a dual sleeve configuration (see FIG. 4) where two different sleeves are arranged to absorb either an up-thrust force or a down-thrust force.

The diffuser subassembly 64 may be pre-assembled in a stable configuration. Since the flange 84 is entrained or captured between the two bushings 58 (even without being coupled to a drive shaft), the sleeve will be maintained within the diffuser body 46 during transport and assembly, thus facilitating assembly of the ESP 20 (FIG. 1). Capturing a sleeve during assembly may be less feasible in configurations with a flange at one end of the sleeve (see FIG. 4). The diffuser subassembly 64 may be employed in high temperature wells in SAGD applications. Generally, only compression pumps having only radial support bearings are used since the bushings must be retained in place from the outside. Because the sleeve 56 and bushings 58 are retained, the subassembly 64 has the capability to provide radial, upward and downward thrust protection.

The diffuser subassembly 64 may be constructed by first securing a first one of the bushings 58 to the diffuser body 46. For example, the bushing 58 may be press fit into the bore 70. Next, the sleeve 56 may be placed in the bore 70 such that the upper thrust surface 88*u* on the sleeve is adjacent to the complementary thrust surface 90 defined on the first bushing 56. Next, the second bushing 58 may be secured within the bore 70 of the diffuser body 46 such that the thrust surface 90 on the second bushing is adjacent the complementary lower thrust surface 88*l* defined on the sleeve 56 opposite the upper thrust surface 88*u* to thereby capture the sleeve 56 within the bore of the diffuser body 46. The lock rings 68 may then be optionally secured in the bore on opposite axial sides of the first and second bushings 58 to further secure the sleeve within the bore 70.

With the sleeve 56 captured, the sleeve 56 may be coupled to the drive shaft 24 of an ESP 20 (FIG. 1). For example, the drive shaft 24 may rotationally coupled to the sleeve 56 by engaging a key slot 98 (FIG. 3A) with a corresponding key 99 (see FIG. 2) defined on the drive shaft 24. In other embodiments, (not shown) a key may be defined on the drive shaft and a key-slot may be defined sleeve.

Figure 4:
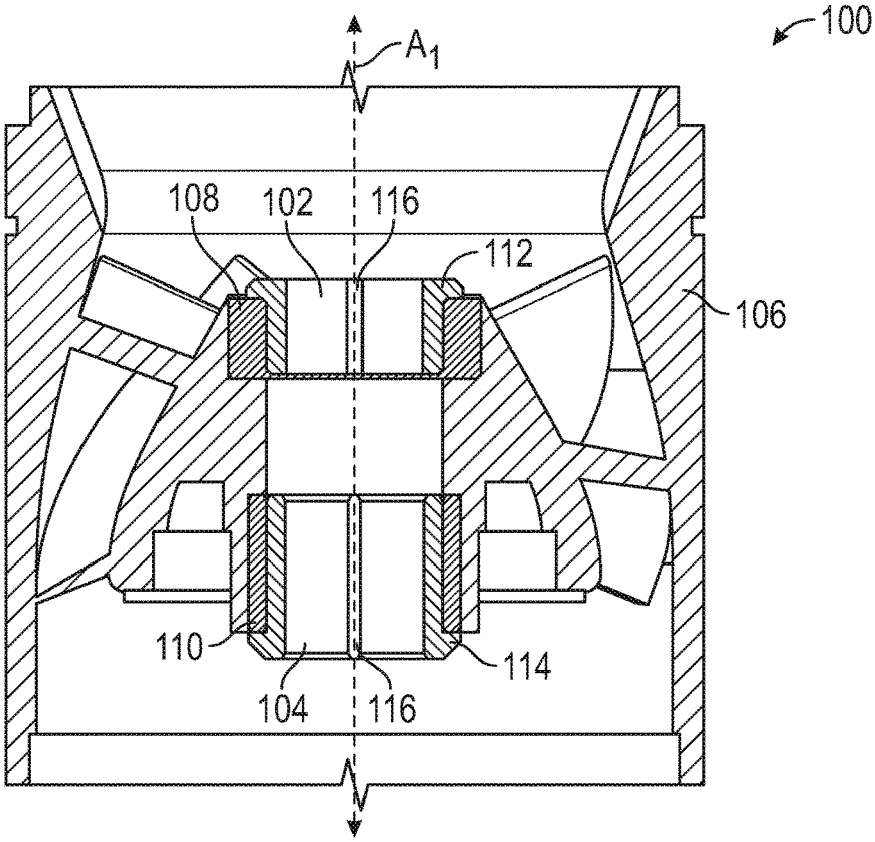
FIG. 4 is a cross-sectional side view of an alternate embodiment of a diffuser assembly having a pair of flanged sleeves for supporting a drive shaft.

Referring now to FIG. 4, an alternate embodiment of a diffuser subassembly 100 is illustrated including a pair of sleeves 102, 104 disposed within a diffuser body 106 defining a longitudinal axis $A_1$. A pair of bushings 108, 110 may be press-fit into the diffuser body 106, and one of the sleeves 102, 104 may be supported within a respective one of the bushings 108, 110. The upper sleeve 102 includes a flange 112 at an upper axial end thereof, which may accommodate a down-thrust force of a drive shaft (not shown) extending through the sleeve 102. The lower sleeve 104 includes a flange 114 at a lower axial end thereof, which may accommodate and up-thrust force of the shaft. The flanges 112, 114 arranged at longitudinal or axial ends of the sleeves 102, 104 are not axially captured in the diffuser subassembly 100, but may be captured when the diffuser subassembly 100 is assembled into a larger ESP pump assembly (not shown).

Each of the sleeves 102, 104 includes a key-slot 116 therein, which may facilitate rotationally coupling the sleeves 102 to a drive shaft. The drive shaft may then rotate with respect to the diffuser body 106 housing about the longitudinal axis to drive the rotation of an impeller 44 (FIG. 2).

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed a diffuser subassembly for a downhole submersible pump. The diffuser subassembly includes a diffuser body defining a bore extending along a longitudinal axis, the diffuser body including a fluid flow path around the bore arranged to reduce a velocity of a fluid flowing therethrough while increasing a static pressure of the fluid. An upper bushing is pressed into the bore, and defines a first thrust surface on lower surface thereof within the bore. A lower bushing is pressed into the bore, and defines a second thrust surface on an upper surface thereof within the bore. The diffuser assembly also includes a sleeve for receiving a drive shaft. The sleeve defines upper and lower thrust surfaces thereon disposed axially between the first and second thrust surfaces of the upper and lower bushings.

In some example embodiments, the upper and lower thrust surfaces are defined on a flange extending radially from a sleeve body portion. The flange may intersect an axial center of the sleeve body portion.

In one or more embodiments, the diffuser body defines a circumferential rim extending radially into the bore, and at least one gap is defined within the circumferential rim for receiving a tab of at least one of the first and second bushings to prohibit free rotation of the first and second bushings with respect to the diffuser body. The first and second bushings may be pressed into the diffuser body such that a perimeter of at least one of the first or second thrust surfaces engages the circumferential rim.

In some embodiments the diffuser subassembly further includes a pair of lock rings disposed on opposite axial sides of the first and second bushings and engaged with the diffuser body so as to retain the first and second bushings within the diffuser body. In some embodiments, the diffuser body includes a fluid flow passage therein, and the fluid flow passage extends at an oblique angle with respect to the longitudinal axis into the central bore.

According to another aspect, the disclosure is directed to a downhole submersible pump. The submersible pump includes an electrical motor and a drive shaft operably coupled to the electrical motor for selective rotation of the drive shaft about a longitudinal axis. An impeller is coupled to the drive shaft such that rotation of the drive shaft about the longitudinal axis rotates the impeller about the longitudinal axis. A diffuser body is disposed adjacent the impeller, and the diffuser body defines a bore extending along the longitudinal axis and receiving the drive shaft therein. An upper bushing is disposed within the bore, the upper bushing defining a first thrust surface on lower surface thereof within the bore. A lower bushing is disposed within the bore, the lower bushing defining a second thrust surface on an upper surface thereof within the bore. A sleeve receives the drive shaft therein; the sleeve defines upper and lower thrust surfaces thereon disposed axially between the first and second thrust surfaces of the upper and lower bushings.

In one or more exemplary embodiments, the drive shaft is rotationally coupled to the sleeve by a keyed slot defined on at least one of the drive shaft and the sleeve. At least one of the bushings may be rotationally fixed to the diffuser body by a tab defined on one of the diffuser body and the at least one of the bushings extending into a gap defined on the other of the diffuser body and the at least one of the bushings. In some embodiments, the wellbore pump further includes an impeller and diffuser stack including the impeller and diffuser body and at least one additional impeller coupled to the drive shaft and at least one additional diffuser body circumscribing the drive shaft.

In some example embodiments, the sleeve may be axially captured within the bore by the upper and lower bushings. The sleeve may include a central flange extending radially from a sleeve body portion, and the central flange may define the upper and lower thrust surfaces thereon disposed axially between the upper and lower bushings. In one or more embodiments, the upper and lower bushings may be secured in the diffuser body by at least one of an interference fit with the diffuser body and a lock ring disposed on axial sides of the first and second bushings.

According to still another aspect, the disclosure is directed to a method of assembling a downhole submersible pump. The method includes (a) securing a first bushing within a bore of a diffuser body, (b) disposing a sleeve within the bore of the diffuser body such that an upper thrust surface on the sleeve is adjacent to a complementary thrust surface defined on the first bushing, (c) securing a second bushing within the bore of the diffuser body such that a thrust surface on the second bushing is adjacent a complementary lower thrust surface defined on the sleeve opposite the upper thrust surface to thereby capture the sleeve within the bore of the diffuser body, and (d) coupling, after securing the second bushing, the sleeve to a drive shaft of the submersible pump.

In one or more example embodiments, coupling the sleeve to the drive shaft includes rotationally coupling the drive shaft to the sleeve by engaging a key on one of the drive shaft and the sleeve with a keyslot defined on the other of the drive shaft and the sleeve. Securing the first bushing within a bore of a diffuser body may include rotationally coupling the first bushing with the diffuser body by inserting a tab defined on the first bushing with a gap defined within the diffuser body.

In some embodiments, disposing the sleeve within the bore includes aligning a central flange of the sleeve with the thrust surface defined on the first bushing. Securing the second bushing within the bore may include aligning the thrust surface on the second bushing with the central flange of the sleeve to thereby axially capture the central flange between the first and second bushings. Securing the first and second bushings within the bore may include at least one of forming an interference fit between the first and second bushing with the diffuser body and securing a pair of lock rings on opposite axial sides of the first and second bushings.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A diffuser subassembly for a wellbore pump, the diffuser subassembly comprising:

a diffuser body defining a bore extending along a longitudinal axis, the diffuser body including a fluid flow path around the bore arranged to reduce a velocity of a fluid flowing therethrough while increasing a static pressure of the fluid;

a first bushing pressed into the bore and secured within the bore, the first bushing defining a first thrust surface on a lower surface thereof within the bore;

a second bushing pressed into the bore and secured within the bore, the second bushing defining a second thrust surface on an upper surface thereof within the bore; and a sleeve for receiving a drive shaft, the sleeve defining upper and lower thrust surfaces thereon disposed axially between the first and second thrust surfaces of the first and second bushings, the sleeve captured between the first bushing and the second bushing independent of the sleeve being coupled to the drive shaft.

2. The diffuser subassembly of claim 1, wherein the upper and lower thrust surfaces are defined on a flange extending radially from a sleeve body portion.

3. The diffuser subassembly of claim 2, wherein the flange intersects an axial center of the sleeve body portion.

4. The diffuser subassembly of claim 1, wherein the diffuser body defines a circumferential rim extending radially into the bore, and wherein at least one gap is defined within the circumferential rim for receiving a tab of at least one of the first and second bushings to prohibit free rotation of the first and second bushings with respect to the diffuser body.

5. The diffuser subassembly of claim 4, wherein the first and second bushings are pressed into the diffuser body such that a perimeter of at least one of the first or second thrust surfaces engages the circumferential rim.

6. The diffuser subassembly of claim 1, further comprising a pair of lock rings disposed on opposite axial sides of the first and second bushings and engaged with the diffuser body so as to retain the first and second bushings within the diffuser body.

7. The diffuser subassembly of claim 1, wherein the diffuser body includes a fluid flow passage therein, the fluid flow passage extending at an oblique angle with respect to the longitudinal axis into the central bore.

8. A wellbore pump, comprising:

an electrical motor;

a drive shaft operably coupled to the electrical motor for selective rotation of the drive shaft about a longitudinal axis;

an impeller coupled to the drive shaft such that rotation of the drive shaft about the longitudinal axis rotates the impeller about the longitudinal axis;

a diffuser body adjacent the impeller, the diffuser body defining a bore extending along the longitudinal axis and receiving the drive shaft therein;

an upper bushing disposed within the bore, the upper bushing defining a first thrust surface on a lower surface thereof within the bore;

a lower bushing disposed within the bore, the lower bushing defining a second thrust surface on an upper surface thereof within the bore; and a sleeve receiving the drive shaft therein such that the sleeve is axially spaced from the impeller; the sleeve defining upper and lower thrust surfaces thereon disposed axially between the first and second thrust surfaces of the upper and lower bushings.

9. The wellbore pump of claim 8, wherein the drive shaft is rotationally coupled to the sleeve by a keyed slot defined on at least one of the drive shaft and the sleeve.

10. The wellbore pump of claim 8, wherein at least one of the bushings is rotationally fixed to the diffuser body by a tab defined on one of the diffuser body and the at least one of the bushings extending into a gap defined on the other of the diffuser body and the at least one of the bushings.

11. The wellbore pump of claim 8, further comprising an impeller and diffuser stack including the impeller and diffuser body and at least one additional impeller coupled to the drive shaft and at least one additional diffuser body circumscribing the drive shaft.

12. The wellbore pump of claim 8, wherein the sleeve is axially captured within the bore by the upper and lower bushings.

13. The wellbore pump of claim 12, wherein the sleeve includes a central flange extending radially from a sleeve body portion, and wherein the central flange defines the upper and lower thrust surfaces thereon disposed axially between the upper and lower bushings.

14. The wellbore pump of claim 8, wherein the upper and lower bushings are secured in the diffuser body by at least one of an interference fit with the diffuser body and a lock ring disposed on axial sides of the first and second bushings.

15. A method of assembling a wellbore pump, the method comprising:

securing a first bushing within a bore of a diffuser body;

disposing a sleeve within the bore of the diffuser body such that an upper thrust surface on the sleeve is adjacent to a complementary thrust surface defined on the first bushing;

securing a second bushing within the bore of the diffuser body such that a thrust surface on the second bushing is adjacent a complementary lower thrust surface defined on the sleeve opposite the upper thrust surface to thereby capture the sleeve within the bore of the diffuser body; and coupling, after securing the second bushing, the sleeve to a drive shaft of the submersible pump.

16. The method according to claim 15, wherein coupling the sleeve to the drive shaft comprises rotationally coupling the drive shaft to the sleeve by engaging a key on one of the drive shaft and the sleeve with a keyslot defined on the other of the drive shaft and the sleeve.

17. The method according to claim 15, wherein securing the first bushing within the bore of the diffuser body comprises rotationally coupling the first bushing with the diffuser body by inserting a tab defined on the first bushing with a gap defined within the diffuser body.

18. The method according to claim 15, wherein disposing the sleeve within the bore comprises aligning a central flange of the sleeve with the thrust surface defined on the first bushing.

19. The method according to claim 18, wherein securing the second bushing within the bore comprises aligning the thrust surface on the second bushing with the central flange of the sleeve to thereby axially capture the central flange between the first and second bushings.

20. The method according to claim 19, wherein securing the first and second bushings within the bore comprises at least one of forming an interference fit between the first and second bushing with the diffuser body and securing a pair of lock rings on opposite axial sides of the first and second bushings.

* * * * *